US006555051B1

(12) United States Patent
Sakata et al.

(10) Patent No.: US 6,555,051 B1
(45) Date of Patent: Apr. 29, 2003

(54) METHOD FOR PRODUCING SINTERED BODY

(75) Inventors: Masaaki Sakata, Matsumoto (JP); Kenichi Shimodaira, Komagame (JP)

(73) Assignee: Injex Corporation (JP)

( * ) Notice: Subject to any disclaimer, the term of this patent is extended or adjusted under 35 U.S.C. 154(b) by 0 days.

(21) Appl. No.: 09/581,672

(22) PCT Filed: Oct. 8, 1999

(86) PCT No.: PCT/JP99/05599

§ 371 (c)(1),
(2), (4) Date: Jun. 12, 2000

(87) PCT Pub. No.: WO00/21703

PCT Pub. Date: Apr. 20, 2000

(30) Foreign Application Priority Data

Oct. 13, 1998 (JP) ..... 10-291210

(51) Int. Cl.[7] ..... B22F 3/20
(52) U.S. Cl. ..... 419/41; 419/37
(58) Field of Search ..... 419/37, 41

(56) References Cited

U.S. PATENT DOCUMENTS

| | | | | |
|---|---|---|---|---|
| 2,787,022 A | | 4/1957 | Chisholm | |
| 3,155,502 A | * | 11/1964 | Brown | 75/214 |
| 4,457,851 A | * | 7/1984 | Tabaru et al. | 252/62.63 |
| 5,464,670 A | * | 11/1995 | Ikuma et al. | 428/35.8 |
| 5,733,580 A | * | 3/1998 | Ikuma et al. | 425/3 |

FOREIGN PATENT DOCUMENTS

| | | | | |
|---|---|---|---|---|
| EP | 0639417 A1 | | 2/1995 | |
| JP | 60-216512 | | 10/1985 | |
| JP | 60-216512 A | * | 10/1985 | H01F/7/02 |
| JP | 09148166 | | 6/1997 | |
| JP | 9-148166 | | 6/1997 | |
| JP | 09-148166 A | * | 6/1997 | H01F/41/02 |
| KR | 1989-9507 | | 8/1989 | |

OTHER PUBLICATIONS

Korean Intellectual Property Office Reasons for Rejection and Translation Thereof, Feb. 26, 2002.

* cited by examiner

*Primary Examiner*—Daniel J. Jenkins
(74) *Attorney, Agent, or Firm*—Harness, Dickey & Pierce, P.L.C.

(57) ABSTRACT

In a method for manufacturing a sintered body of the present invention, a feed stock including metal powder, a binder, and an organic material having a melting point lower than that of the binder is extrusion molding by using an extruder 1, so that an extruded body having a desired shape (cross-sectional shape) and dimensions is manufactured. In this method, a temperature of an extrusion side die 52 of an extrusion die 5 is lower than the melting point of the binder and higher than that of the organic material. Next, a debinding treatment (treatment for removing binder) of the obtained extruded body is performed. The debinding treatment is separately performed by a first process in a low temperature region and a second process in a temperature region higher than that in the first process. Subsequently, an obtained debounded body is sintered by baking in a sintering furnace, whereby the sintered body (metal product) is manufactured.

20 Claims, 3 Drawing Sheets

METHOD FOR PRODUCING SINTERED BODY

TECHNICAL FIELD

The present invention relates to a method for manufacturing a sintered body, in which the sintered body is formed by sintering an extruded body comprised of metal powder.

BACKGROUND ART

Hot extrusion for extruding a metal material through an extrusion die and for forming the metal material into a predetermined shape has been well known. By the extrusion mentioned above, for example, a metal product in a continuous form can be manufactured.

However, in the hot extrusion described above, the production facility is large, and the metals which can be used are limited (for example, high speed steel, die steel, hard material, and the like, are difficult to be processed by hot extrusion), and in addition, there is a problem in that dimensional accuracy of the metal product is poor.

An object of the present invention is to provide a method for manufacturing a sintered body, in which there is a large degree of freedom for selecting usable metals and a metal product (particularly, a product in a continuous form or a product cut therefrom) having superior dimensional accuracy can be easily obtained.

DISCLOSURE OF INVENTION

The object described above can be achieved by the present invention described in (1) to (8) below.

(1) A method for manufacturing a sintered body comprises an extruding molding step of extruding a feed stock comprising metal powder and a binder from an extrusion die of an extruder so as to form an extruded body, a debinding step of debinding the extruded body, and a sintering step of sintering the debound extruded body so as to manufacture the sintered body, wherein, in the extrusion molding step, the extrusion die is provided with a temperature gradient along the extrusion direction.

(2) The temperature gradient described above is preferably provided so that a temperature of the extrusion die at an extrusion opening side is lower.

(3) The feed stock described above preferably further comprises an organic material having a melting point which is lower than that of the binder.

(4) The organic material preferably functions as a binder.

(5) The melting point of the binder is preferably 80 to 300° C. and the melting point of the organic material is preferably −50 to 80° C.

(6) The extrusion molding step described above is preferably performed at a temperature of the extrusion die of less than the melting point of the binder and more than the melting point of the organic material in the vicinity of the extrusion opening.

(7) The extrusion molding described above is preferably performed in which a temperature of the extrusion die in the vicinity of the extrusion opening is controlled using a cooling unit and a heating unit.

(8) The debinding step preferably further comprises a first process of debinding performed in a low temperature region and a second process of debinding performed in a temperature region higher than that in the first process.

BEST MODE FOR CARRYING OUT THE INVENTION

Figure 1:
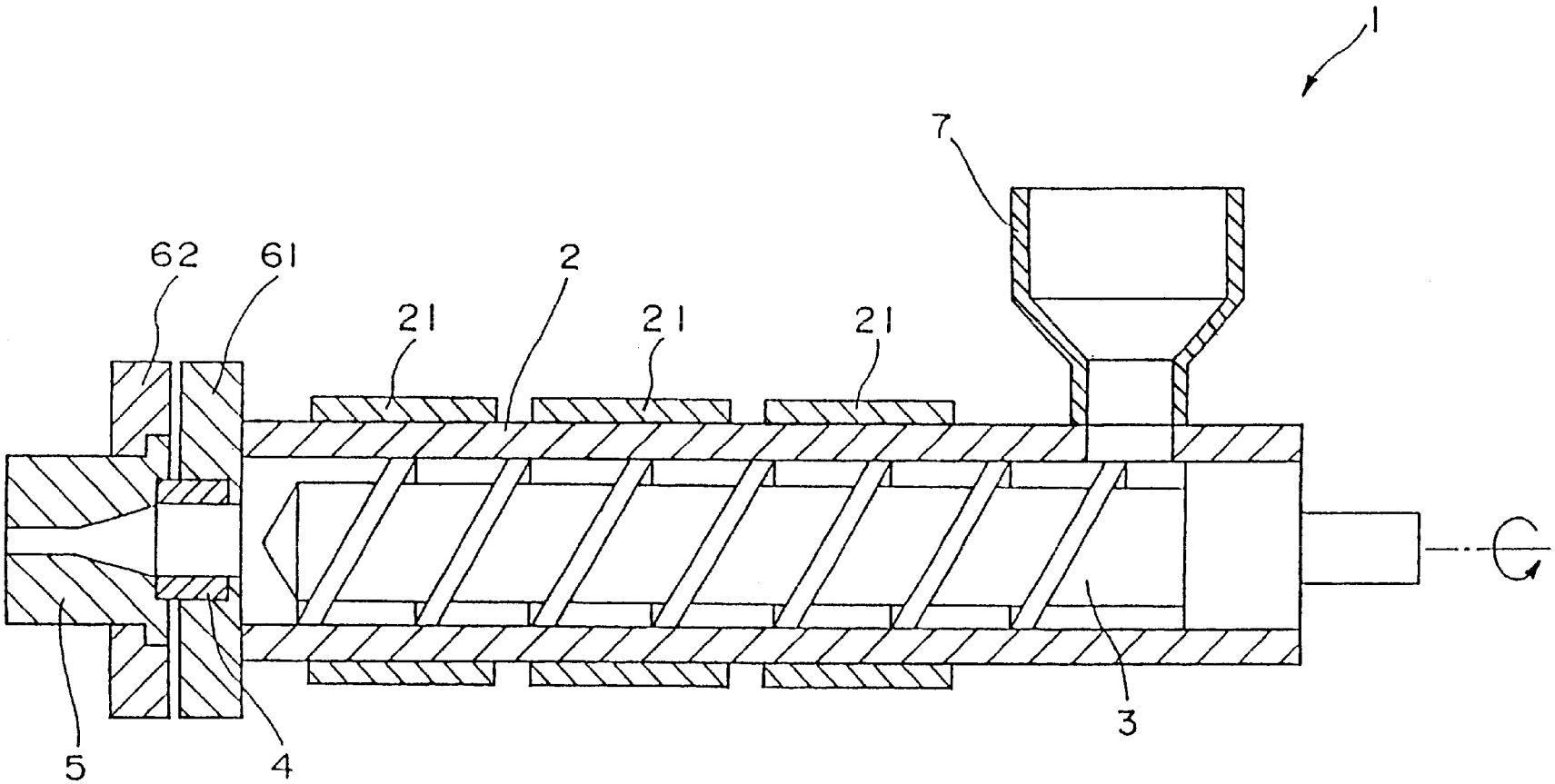
FIG. 1 is a cross-sectional view of an example of a configuration of an extruder used for the present invention.

A method for manufacturing a sintered body of the present invention will be further illustrated with reference to preferable examples.

[1A] Manufacturing of a Feed Stock

The feed stock used for the present invention includes metal powder and a binder (binding agent), and preferably, includes an organic material having a melting point lower than that of the binder.

A metal material (hereinafter simply referred to as "metal material") composing the metal powder, which is not specifically limited, for example, is at least one metal selected from the group constituting Fe, Ni, Co, Cr, Mn, Zn, Pt, Au, Ag, Cu, Pd, Al, W, Ti, V, Mo, Nb, Zr, Pr, Nd, Sm, and the like, or an alloy including (primarily) at least one metal mentioned above.

In particular, as the metal powder, stainless steel (for example, SUS 304, SUS 316, SUS 317, SUS 329J1, SUS 410, SUS 430, SUS 440, and SUS 630, a Fe alloy represented by die steel, high speed tool steel, and the like, Ti or a Ti alloy, W or a W alloy, a Co-based hard metal, and a Ni-based cermet are preferable.

A metal composing the Ti alloy other than Ti is, for example, at least one selected from the group constituting Fe, Ni, Cr, Pd, Co, Zr, Al, V, Mo, Sn, Au, Ag, and Cu. In this case, the total content of metals other than Ti is preferably not more than 60 percent by weight, and more preferably, less than 50 percent by weight.

In addition, an average particle diameter of the metal powder is not specifically limited; however, it is preferably not more than 150 $\mu$m, and commonly, it is more preferably in the range from approximately 0.1 to 60 $\mu$m. When the average particle diameter is too large, the sintered density may be lowered in some cases depending on different conditions.

A manufacturing method of the metal powder is not specifically limited. For example, metal powder manufactured by a water or a gas atomization method, a reduction method, a carbonyl method, and a pulverizing method may be used.

As the binder, for example, a polyolefinic resin, such as polyethylene, polypropylene, and an ethylene-vinyl acetate copolymer; an acrylic resin, such as polymethyl methacrylate and polybutyl methacrylate; a styrenic resin such as polystyrene; polyvinyl chloride; polyvinylidene chloride; a polyamide; a polyester; a polyether; polyvinyl alcohol; or various resins, such as a copolymer of the resins mentioned above, may be used alone or in combination.

The organic material is not specifically limited so long as the melting point thereof is below that of the binder to be used. For example, various waxes, paraffins, higher fatty acids (such as stearic acid), higher alcohols, higher fatty acid esters, higher fatty acid amides, phthalic acid esters (for example, DOP, DEP, and DBP), adipic acid esters, trimellitic acid esters, sebacic acid esters, and the like, may be used alone or in combination as an organic material.

In particular, the organic material preferably functions as a binder.

Among the organic materials described above, waxes, paraffins, and the like are the organic materials having functions as a binder.

The functions (bonding force and the like) of the organic materials as a binder may be lower than that of the binders described above.

In the case in which the feed stock includes the metal powder, the binder, and the organic material, the melting point of the binders is preferably approximately 80 to 300° C. and is more preferably approximately 80 to 250° C.

Meanwhile, the melting point of the organic material is preferably approximately −50 to 80° C. and is more preferably approximately −40 to 60° C.

When the binders and the organic materials having the respective melting points described above are used, the dimensional accuracy can be specifically improved.

The metal powder and the binder are prepared, preferably, the metal powder, the binder, and the organic material are prepared, and the mixture thereof is then kneaded by a kneading machine, whereby the kneaded product (feed stock) is obtained.

In the step for kneading, other than the metal powder, the binder, and the organic material, various additives, such as a lubricant, an anti-oxidation agent, a debinding promoter, and a surfactant, may be added when necessary.

Kneading conditions differ depending on the metal composition and the particle diameter of the metal powder, compositions of the binder and the organic material, which are to be used, and the blending amounts thereof. One example of the kneading conditions is that the kneading temperature is approximately 50 to 250° C. and the kneading time is approximately 20 to 210 minutes.

The feed stock is formed into pellets (small forms) when necessary. The diameter of the pellet is, for example, approximately 1 to 10 mm.

[2A] Extrusion molding

Next, by using the feed stock obtained in the process [1A] described above or the pellets formed from the feed stock (hereinafter simply called "feed stock"), extrusion molding is performed by an extruder, whereby an extruded body having a desired shape (cross-sectional shape) and dimensions is manufactured.

In this process, when the extrusion molding is performed, an extrusion die of the extruder is provided with a step-wise or continuous temperature gradient along the extrusion direction, preferably, so as to be lower at the extrusion opening side.

The shape and the dimensions of the extruded body to be manufactured are determined in consideration of the shrinkage of the extruded body caused in the following debinding and sintering steps.

Figure 2:
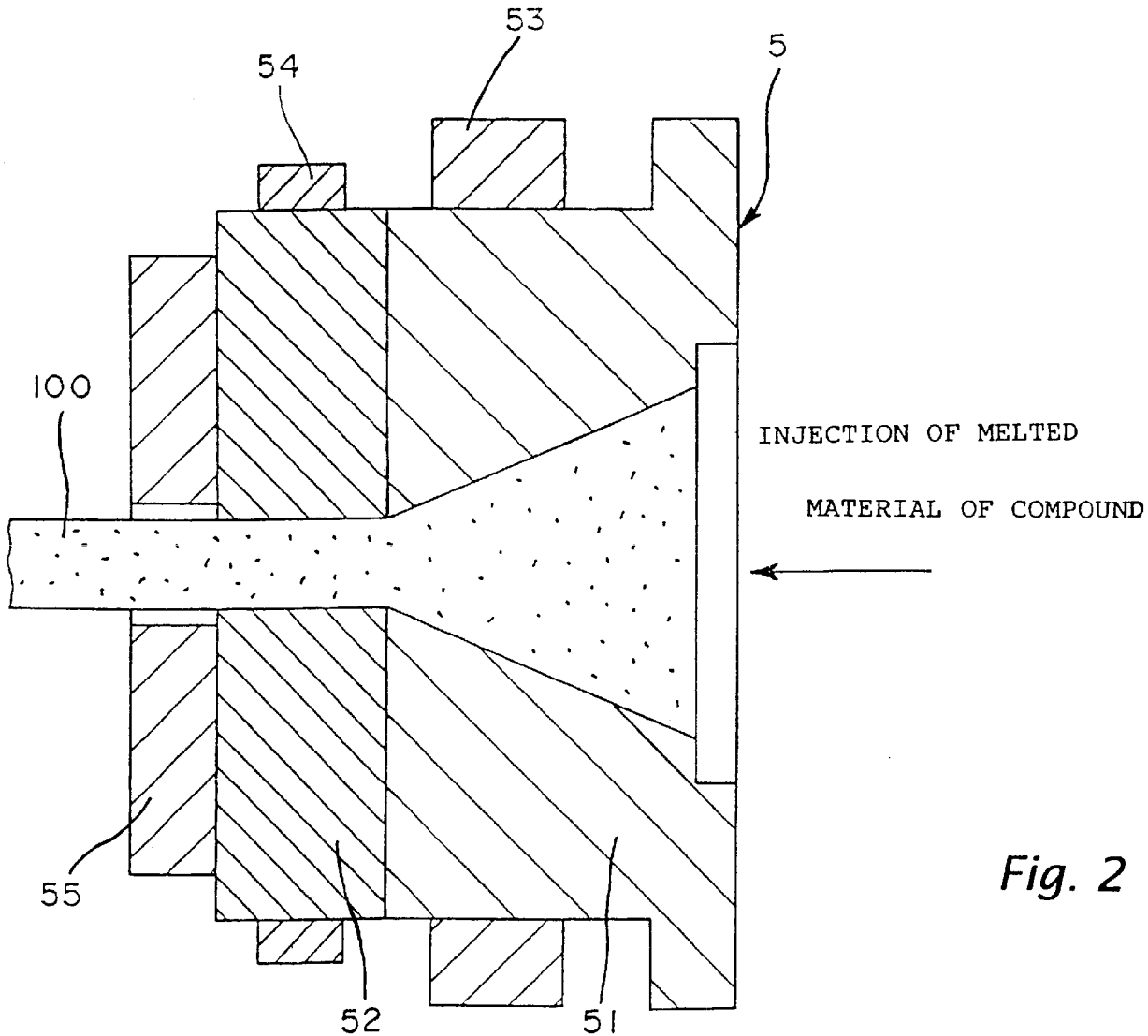
FIG. 2 is a cross-sectional view of an extrusion die (mold) and the vicinity thereof of the extruder shown in FIG. 1.

FIG. 1 is a cross-sectional view of a structural example of the extruder used for the present invention, and FIG. 2 is a c ross-sectional view of the extrusion die (mold) and the vicinity thereof of the extruder shown in FIG. 1. For convenience of the explanation, the left side and right side of the extruder in FIGS. 1 and 2 are called a "front end" and a "base end", respectively.

The extruder 1 shown in the figures is a screw extruder which comprises a mounting (not shown), a cylinder 2 supported by the mounting, adapter plates 61 and 62, a breaker ring 4, an extrusion die (mold) 5, a screw 3 which rotates in the cylinder 2, a driving mechanism (not shown) which rotationally drives the screw 3, and a hopper 7 which stores the feed stock and supplies the feed stock into the cylinder 2.

The breaker ring 4 and the extrusion die 5 are disposed between the adapter plates 61 and 62 and are connected to the front end of the cylinder 2 by the adapter plates 61 and 62. In this case, the breaker ring 4 is located between the cylinder 2 and the extrusion die 5. The adapter plates 61 and 62 are connected by screws (not shown).

In addition, heaters (heating units) 21 are provided at the periphery of the cylinder 2.

As shown in FIG. 2, the extrusion die 5 is composed of an injection side die 51 having a tapered inner diameter gradually shrinking toward the extrusion opening side and an extrusion side die 52 defining the shape of the extruded body. Hollow portions of the injection side die 51 and the extrusion side die 52 are connected.

A heater 53 (heating unit) is provided at the periphery of the injection side die 51.

A heater 54 (heating unit) is provided at the periphery of the extrusion side die 52 and a cooling unit 55 is provided at the front end (side wall at an extrusion opening side).

Next, referring to FIGS. 1 and 2, extrusion molding using the extruder 1 will be described.

The feed stock (not shown) supplied in the hopper 7 is fed into the cylinder 2.

Meanwhile, the screw 3 is rotationally driven in a predetermined direction at a predetermined rotational frequency (rotational speed) by the driving mechanism.

When the screw 3 rotates in the predetermined direction, the feed stock fed into the cylinder 2 is gradually transported in the cylinder 2 toward the front end side by the screw 3.

The rotational frequency of the screw 2 is not specifically limited; however, it is preferably, for example, 1 to 250 rpm.

The cylinder 2 and the injection side die 51 are heated by the heaters 21 and 53, respectively, so as to have a predetermined temperature profile. The feed stock is heated at or above the melting temperature (melting point) of the binder (thermoplastic) in the feed stock and is melted while being transported in the cylinder 2 toward the front end side. The viscosity of the melted material of the feed stock becomes low, so that the fluidity thereof is improved, and air pores in the melted material are removed by compaction thereof.

The temperatures of the cylinder 2 and the injection side die 51 are not specifically limited and are appropriately determined in accordance with the binder, the organic material, and the like, to be used. However, it is preferably approximately 100 to 400° C., and more preferably, approximately 120 to 350° C.

The melted material of the feed stock is fed from a front edge of the cylinder 2 into the breaker ring 4, is transported in the breaker ring 4 toward the extrusion die 5 side, and is then injected from a front edge of the breaker ring 4 into the extrusion die 5.

Subsequently, the melted material of the feed stock fed into the extrusion die 5 is continuously extruded from the extrusion die 5, so that the melted material is formed into a predetermined shape.

In this case, the temperatures at the extrusion side die 52 are controlled to have a predetermined temperature gradient by the cooling unit 55 and the heater 54 so as to cool and solidify the melted material of the feed stock. When the temperature of the extrusion side die 52 is higher than the predetermined temperature, the extrusion side die 52 is cooled by the cooling unit 55, and in contrast, when the temperature of the extrusion side die 52 is lower than the predetermined temperature, the extrusion side die 52 is heated by the heater 54.

Consequently, the material extruded from the injection side die 51 is cooled when passing through the extrusion side die 52 and solidified. Accordingly, an extruded body 100 in a continuous form is continuously manufactured.

The extruded body 100 is cut into a predetermined length, and extruded products having desired shapes and dimensions are obtained.

The temperature of the extrusion side die 52 (temperature of the extrusion die 5 around the extrusion opening) is preferably set to be lower than the temperature of the injection side die 51 (temperature of the extrusion die 5 around the injection opening), and specifically, is preferably set to be lower than the melting point of the binder and to be higher than the melting point of the organic material.

Since the extrusion molding, in which the temperature of the extrusion side die 52 is lower than the melting point of the binder and is higher than the melting point of the organic material, is performed, the organic material in the feed stock is in the melted state and the binder is only solidified. Consequently, the extruded body 100 is extruded from the extrusion die 5 while maintaining the shape thereof. That is, smooth and secure extrusion molding can be performed. The extruded body 100 formed by extrusion molding can maintain its shape, so that further improved dimensional accuracy thereof can be achieved.

The temperature of the extrusion side die 52 is not specifically limited, and is appropriately determined by the binder, the organic material, and the like to be used; however, it is preferably approximately 30 to 120° C., and more preferably, approximately 30 to 90° C.

The extrusion pressure is preferably not more than 1,000 $kg/cm^2$, and more preferably, not more than 500 $kg/cm^2$.

The extrusion speed is preferably approximately 0.1 to 50 mm/sec, and more preferably, approximately 0.2 to 20 mm/sec.

The transverse cross-sectional shape of the extruded body 100 is determined by the shape of the extrusion opening of the extrusion die 5 to be selected.

When the extrusion die 5 is composed of a single die, an extruded body (metal product as a finished product) in the form of a circular bar or in the form of a plate is obtained and when the extrusion die is composed of an outer die and an inner die, an extruded body (metal product as a finished product) in the form of a hollow shape such as a circular cylinder is obtained. In addition, a thin-walled extruded body or extruded body having an irregular cross-sectional shape can be easily manufactured in accordance with a shape of the extrusion opening of the extrusion die 5 to be selected. Furthermore, by an adjustment of cutting length of the extruded body 100, the extruded products (metal products as a finished product) having various lengths, such as a flat and a continuous form, can be manufactured.

Hereinbefore, the screw extruder was representatively described; however, the present invention is not limited thereto. Extrusion molding may be performed using other machines such as a ram extruder. The ram extruder has a structure provided with a piston, which moves back and forth in the cylinder 2 in place of the screw 3, in the extruder 1 shown in FIG. 1.

In the present invention, a mixture of the compositions, in place of the feed stock, may be stored in the hopper 7 and may be fed into the cylinder 2.

It is clearly understood that, in the present invention, the extrusion conditions and the like are not limited to the ranges described above.

[3A] Debinding Treatment of the Extruded Body

A debinding treatment (treatment for removing binder) of the extruded body obtained in the process [2A] described above is performed.

As the debinding treatment, heat treatment in a non-oxidizing atmosphere, such as in a vacuum or under an reduced pressure (for example, $1\times10^{-1}$ to $1\times10^{-6}$ Torr), or in an inert gas atmosphere, such as nitrogen gas and argon gas, is performed.

In this case, the heating condition is preferably at approximately 150 to 750° C. for approximately 0.5 to 40 hours, and more preferably, at approximately 250 to 650° C. for approximately 1 to 24 hours.

Debinding by the heat treatment thus described may be performed by a plurality of processes (steps) depending on individual purposes (for example, for shortening a debinding time). In this case, there are, for example, a method for performing a debinding treatment at low temperature in a first half and at high temperature in a second half, or a method for performing a debinding treatment repeatedly at low and high temperatures.

Figure 3:
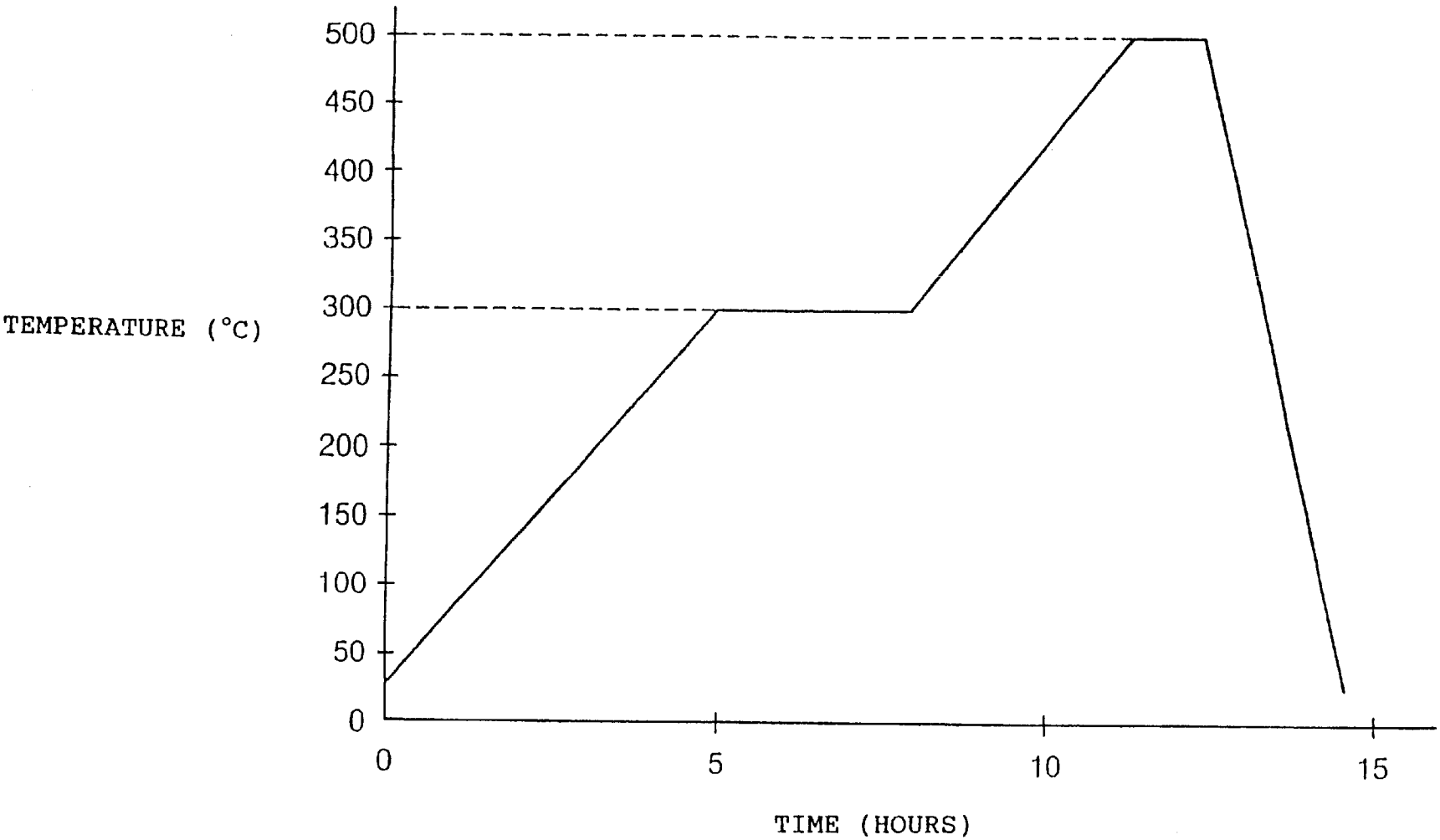
FIG. 3 is a graph showing an example of changes in a furnace temperature vs. time in a debinding step of the present invention.

In particular, when the extruded body is composed of the metal powder, the binder, and the organic material, debinding is preferably performed by a first process for debinding in a low temperature region and a second process for debinding in a temperature region higher than that of the first process (refer FIG. 3). In this case, it is preferable that debinding in a low temperature region (the first process) be performed first and then debinding in a high temperature region (the second process) be performed.

In general, a decomposition temperature of a resin and the like relates to the melting point thereof, and the decomposition temperature of the organic material in the extruded body is lower than that of the binder. Hence, when debinding, the organic material having the lower decomposition temperature is decomposed and removed in the first process, and then the binder having the higher decomposition temperature is decomposed and removed in the second process. In the second process described above, the binder is removed through voids (air pores) formed by the decomposition and removal of the organic material.

By this two-stage debinding, debinding can be efficiently performed, and the debinding time can be shortened. In addition, generation of debinding defects, such as breakage, can be securely prevented, and debinding from the extruded body is uniformly performed, so that deformation of the extruded body is prevented, and the dimensional accuracy thereof is improved.

A heat treatment condition in the first process is preferably approximately 100 to 400° C. for approximately 0.5 to 30 hours, and more preferably, approximately 150 to 350° C. for approximately 1 to 20 hours.

A heat treatment condition in the second process is preferably approximately 250 to 750° C. for approximately 0.5 to 35 hours, and more preferably, approximately 150 to 350° C. for approximately 1 to 24 hours.

In the present invention, the debinding treatment may be performed by extracting specific components out of the binder, the organic material and the additive, using a predetermined solvent (liquid or gas).

[4A] Sintering

The debinding body (extruded body subjected to debinding treatment) obtained in the process [3A] is baked so as to be sintered in a sintering furnace, whereby the metal sintered body (sintered body) is manufactured.

In the sintering process, the metal powder diffuses and the grains thereof grow so as to form crystal grains, whereby a dense body, i.e., a sintered body having a high density and low porosity, as a whole, is obtained.

The sintering temperature in sintering is not specifically limited; however, when the metal composition is iron or a ferrous alloy, approximately 950 to 1,450° C. is preferable, and approximately 1,100 to 1,400° C. is more preferable, and when the metal composition is titanium or a titanium alloy, approximately 900 to 1,350° C. is preferable, and approximately 1,000 to 1,300° C. is more preferable.

The sintering time, in the case in which the sintering temperatures are as described above, is preferably approximately 0.5 to 8 hours, and more preferably, approximately 1 to 5 hours.

In addition, the sintering atmosphere is preferably a non-oxidizing atmosphere. According to this, reduction of the porosity of the sintered body is achieved.

The sintering atmosphere is preferably an evacuated (vacuum) atmosphere of not more than $1\times10^{-2}$ Torr (more preferably $1\times10^{-2}$ to $1\times10^{-6}$ Torr), an inert gas atmosphere, such as nitrogen gas and argon gas, of 1 to 760 Torr, or a hydrogen gas atmosphere of 1 to 760 Torr.

The sintering atmosphere may be changed while sintering is performed. For example, first, the sintering atmosphere is an evacuated atmosphere (vacuum) of $1\times10^{-2}$to $1\times10^{-6}$ Torr, and is then changed to the inert gas atmosphere described above while sintering is being performed.

By performing the sintering under the conditions described above, further reduction of the porosity, that is, a further densification of the sintered body and improved dimensional accuracy can be achieved. In addition, efficiency of the sintering is superior, and the sintering can be performed in a shorter period of time, w hereby productivity is also improved.

Sintering may be performed by 2 stages or more. For example, a first and a second sintering, which have different conditions from each other, may be performed. In this case, the temperature of the second sintering may be higher than that of the first sintering condition. By the sintering described above, efficiency of the sintering is further improved, and further reduction of the porosity can be achieved.

In the present invention, in accordance with an optional purpose, a process prior to the process [1A], an intermediate process between the processes [1A] to [4A], and a process after the process [4A] may exist.

According to the method for manufacturing the sintered body thus described, the sintered body (metal product), specifically the sintered body in a continuous form and the product cut therefrom, which has higher dimensional accuracy, can be continuously manufactured and which is suitable for mass production, can be manufactured.

In addition, products composed of high speed steel, die steel, hard materials, and the like, specifically the products thereof in a continuous form or the product cut therefrom, which are difficult to be processed by conventional hot extrusion, can be easily manufactured. That is, there is a large degree of freedom for selecting usable metals.

In the case in which the feed stock comprises the metal powder, the binder, and the organic material having the lower melting point than that of the binder, extrusion molding may be performed when the temperature of the extrusion side die 52 of the extrusion die 5 is lower than the melting point of the binder and is higher than the melting point of the organic material, and debinding may be separately performed by the first process and the second process. As a result, according to the extrusion molding and debinding described above, defects, such as deformation, breakage, and sink marks, can be securely-prevented, dimensional accuracy can be improved, and the time for manufacturing can be shortened.

Furthermore, the temperature of the extrusion side die 52 of the extrusion die 5 is controlled using the cooling unit 55 and the heater 54, and hence, the temperature thereof can be securely set to be the targeted temperature.

EXAMPLES

Next, particular examples for carrying out a method for manufacturing a sintered body of the present invention will be described.

Example 1

Metal powder, binders, and organic materials, described below, were mixed, and then kneaded at 135° C. for 1 hour by using a kneading machine, whereby the kneaded product was obtained.

(Metal powder)

Stainless steel powder (SUS316L) (average particle diameter of 8 $\mu$m): 95 wt %

(Binder)

Polyethylene (PE) (melting point of 132° C.): 1.3 wt %, and an ethylene-vinyl acetate copolymer (EVA) (melting point of 84° C.): 1.5 wt %

(Organic materials)

Paraffin wax (melting point of 55° C.): 1.4 wt %, and dibuthylphthalate (DBP) (melting point of −35° C.): 0.8 wt %

Next, the obtained kneaded product was pulverized and then sieved so as to obtain pellets having an average diameter of 3 mm. Subsequently, the pellets were extrusion molded under the conditions described below using the extrusion machine shown in FIG. 1, and a extruded body was cut into circular cylindrical extruded products (outer diameter of ϕ 22.5 mm, inner diameter of ϕ 18.0 mm, and length of 56 mm). As an extrusion die of the extrusion machine, the extrusion die for forming an extruded product in the form of a circular cylinder was used.

Cylinder temperature: 150° C.;

Temperature of extrusion side die of the extrusion die: 140° C.; and

Temperature of injection side die of the extrusion die: 65° C.

Next, the obtained extruded products were debinded in accordance with the temperature conditions shown in FIG. 3 under an evacuated pressure of $1\times10^{-3}$ Torr by using a degreasing furnace.

In a first process, the temperature was held at 300° C. for 3 hours, and in a second process, the temperature was held at 500° C. for 1 hour.

Next, the obtained debound products (the extruded products subjected to the debinding treatment) were sintered at 1,350° C. for 3 hours in an argon atmosphere, so that the sintered products in the form of a circular cylinder (targeted dimensions: a metal product having an outer diameter of ϕ 20.0 mm, an inner diameter of ϕ 16.0 mm, and a length of 50 mm) were obtained.

Example 2

Sintered bodies (targeted dimensions: a metal product having an outer diameter ϕ of 20.0 mm, an inner diameter ϕ of 16.0 mm, and a length of 50 mm) were obtained in a similar manner to those performed in Example 1 except for replacing the raw materials with ones listed below.

(Metal powder)

Stainless steel powder (SUS316L) (average particle diameter of 8 $\mu$m): 95 wt %

(Binder)

Polyethylene (PE) (melting point of 132° C.): 2.5 wt %, and an ethylene-vinyl acetate copolymer (EVA) (melting point of 84° C.): 2.5 wt %

Comparative Example 1

Circular cylindrical metal products (targeted dimensions: an outer diameter of ϕ 20.0 mm, an inner diameter of ϕ 16.0 mm) were manufactured from stainless steel (SUS316L) by hot extrusion. The conditions of the hot extrusion were a temperature of 1,100° C. and an extrusion pressure of 3 tonnage/$cm^2$.

The outer diameters and the inner diameters of the metal products manufactured in Examples 1 and 2, and Comparative Example 1 were measured, and errors on the targeted dimensions were calculated. The results are shown below.

Example 1: Error±0.15%

Example 2: Error±0.40%

Comparative Example 1: Error±3.0%

The methods of Examples 1 and 2, specifically that of Example 1, exhibited superior dimensional accuracy.

In contrast, in the manufacturing method in Comparative Example 1, the dimensional accuracy was poor, high temperature and high pressure were required, and the production facilities were large.

The methods for manufacturing the sintered bodies according to the present invention were described above with reference to each example. However, the present invention is not limited thereto.

As described above, according to the method for manufacturing the sintered bodies of the present invention, since extrusion molding in which the extrusion die is provided with a temperature gradient along the extrusion direction is performed, a sintered metal product (sintered product) having high dimensional accuracy, specifically a product in a continuous form or products cut therefrom, can be easily obtained.

In addition, in the case in which the composition includes metal powder, a binder, and an organic material having lower melting point than that of the binder, moldability during extrusion molding and debinding characteristics during debinding can be improved. Hence, the dimensional accuracy of the sintered metal product can be improved, and the time required for manufacturing the sintered metal product can be shortened.

In the case in which extrusion molding is performed when the temperature of the extrusion die in the vicinity of the extruding opening thereof is lower than the melting point of the binder and is higher than the melting point of the organic material, smooth and secure extrusion molding can be performed. Hence, the dimensional accuracy of the sintered metal product can be improved.

Furthermore, in the case in which the step for debinding comprises a first process for debinding at a lower temperature region and a second process for debinding at a temperature region higher than that of the first process for debinding, debinding can be efficiently performed, the time required for debinding can be shortened, and generation of debinding defects, such as a breakage, can be securely prevented. In addition, the dimensional accuracy of the sintered metal product can be improved.

What is claimed is:

1. A method for manufacturing a sintered body comprising:

an extrusion molding step of extruding a feed stock comprising a metal powder, a binder, and an organic material from an extrusion die including an injection side die and an extrusion side die, wherein said extrusion molding step comprises:

compacting said feed stock in said injection side die;

heating said feed stock during said compacting of said feed stock to a first temperature using a first heater located on said injection side die;

heating said feed stock to a second temperature using a second heater located on said extrusion side die;

ejecting said feed stock from said extrusion side die; and cooling said feed stock during said ejecting of said feed stock using a cooling unit located on said extrusion side die;

wherein said extrusion molding step is performed with an extrusion die temperature lower than the melting point of said binder but higher than the melting point of said organic material in the vicinity of said extrusion opening wherein said extrusion die is also provided with a rapidly changeable temperature gradient along the extrusion direction so that a temperature of said extrusion die at said extrusion side die is lower than said injection side die;

a debinding step of debinding the extruded body; and a sintering step of sintering the debound extruded body so as to manufacture the sintered body.

2. The method for manufacturing a sintered body according to claim 1, wherein the organic material functions as a binder.

3. The method for manufacturing a sintered body according to claim 1, wherein the melting point of the binder is 80 to 300° C. and the melting point or the organic material is −50 to 80° C.

4. A method for manufacturing a sintered body according to claim 1 therefore, wherein the debinding step further comprises a first process of debinding performed in a low temperature region and a second process of debinding performed in a temperature region higher than that in the first process.

5. A method for manufacturing a sintered body according to claim 4, wherein said organic materials are magnetic and non-magnetic.

6. A method for manufacturing a sintered body comprising:

providing a metal powder, a binder, and an organic material, wherein said organic material acts as a lubricant;

mixing and kneading said metal powder, said binder, and said organic material in order to produce a feed stock;

introducing said feed stock to an extrusion machine, said extrusion machine having a hopper, a screw cylinder, and an extrusion die having an injection side die and an extrusion side die;

heating said feed stock passing through said screw cylinder with a plurality of heaters on said screw cylinder to a first temperature above a melting point of said binder;

extruding said feed stock within said extrusion die, wherein a first heater located on said injection side die maintains a second temperature substantially equal to said first temperature above said melting point of said binder during compaction of said feedstock, a second heater located on said extrusion side die lowers said feed stock to a third temperature less than said melting point of said binder, and an extrusion side cooling unit solidifies said feed stock to form an extruded body;

debinding said extruded body; and sintering said debound extruded body so as to manufacture a sintered body;

wherein the extrusion molding step is performed with an extrusion die temperature lower than the melting point of said binder but higher than the melting point of said organic material in the vicinity of an extrusion opening.

7. The method of manufacturing a sintered body of claim 6 wherein said kneading is performed from 50 to 250° C., inclusive, and for 20 to 210 minutes, inclusive.

8. The method of manufacturing a sintered body of claim 6 wherein said metal powder has a particle diameter of not more than 150 $\mu$m.

9. The method of manufacturing a sintered body of claim 8 wherein said metal powder has a particle diameter of 0.1 to 60 $\mu$m, inclusive, to provide an advantageous metal powder density.

10. The method of manufacturing a sintered body of claim 6 wherein said binder has a melting point of 80 to 300° C., inclusive.

11. The method of manufacturing a sintered body of claim 10 wherein said binder has a melting temperature of 80 to 250° C., inclusive.

12. The method of manufacturing a sintered body of claim 6 wherein said organic material has a melting temperature of −50 to 80° C., inclusive.

13. The method of manufacturing a sintered body of claim 12 wherein said organic material has a melting temperature of −40 to 60° C., inclusive.

14. A method for manufacturing a sintered body comprising:

providing a metal powder, a binder, and an organic material, wherein said organic material acts as a lubricant;

mixing and kneading said metal powder, said binder, and said organic material in order to produce a feed stock, wherein said kneading is performed from 50° to 250° C., inclusive, and for 20 to 210 minutes, inclusive;

introducing said feed stock to an extrusion machine, said extrusion machine having a hopper, a screw cylinder, and an extrusion die having an injection side die and an extrusion side die;

heating said feed stock passing through said screw cylinder with a plurality of heaters on said screw cylinder to a first temperature of 100° C.–400° C., said first temperature is above a melting point of said binder;

extruding said feed stock within said extrusion die, wherein a first heater located on said injection side die maintains a second temperature substantially equal to said first temperature, and a second heater in combination with an extrusion side cooling unit located on said extrusion side die cool said feed stock to a third temperature of 30° C.–120° C., said third temperature is lower than said melting point of said binder to form an extruded body;

debinding said extruded body; and sintering said debound extruded body so as to manufacture a sintered body;

wherein the extrusion molding step is performed with an extrusion side die temperature lower than the melting point of the binder but higher than the melting point of the organic material in the vicinity of an extrusion opening.

15. A method for manufacturing a sintered body comprising:

extruding a feed stock with an extrusion machine, said feed stock including a metal powder, a binder, and an organic material, wherein said organic material acts as a lubricant, wherein said extruding of said feed stock includes:

heating said feed stock to a first temperature with a plurality of heaters located on a cylinder of an extrusion machine;

compacting said feed stock in an injection side of a die;

heating said feed stock during said compacting of said feed stock to a first temperature with a first heater located on said injection side of said die;

heating said feed stock to a second temperature with a second heater located on an extrusion side of said die;

ejecting said feed stock from said extrusion side of said die; and cooling said feed stock during said ejecting of said feed stock with a cooling unit located on said extrusion side die to form an extruded body;

debinding said extruded body; and sintering said extruded body to form said sintered body.

16. The method according to claim 15, wherein said first temperature is between 100° C.–400° C.; and said second temperature is between 30° C.–120° C.

17. The method according to claim 15, wherein said debinding said extruded body further comprises:

a first process of debinding performed in a low temperature region;

and a second process of debinding performed in a temperature region higher than that in the first process.

18. The method according to claim 15, wherein the organic material functions as a binder.

19. The method according to claim 15, wherein the melting point of the binder is 80° C. to 300° C. and the melting point of the organic material is −50° C. to 80° C.

20. The method according to claim 15, wherein the metal powder has a particle diameter of not more than 150 $\mu$m.

* * * * *

UNITED STATES PATENT AND TRADEMARK OFFICE

CERTIFICATE OF CORRECTION

PATENT NO. : 6,555,051 B1
DATED : April 29, 2003
INVENTOR(S) : Sakata et al.

It is certified that error appears in the above-identified patent and that said Letters Patent is hereby corrected as shown below:

Title page,
Item [75], Inventors, "Shimodaira","Komagame (JP)" should be -- Komagane (JP) --;
Item [57], ABSTRACT,
Line 4, "molding" should be -- molded --;

Column 2,
Line 27, "630" should be -- 630) --;

Column 3,
Line 55, "c ross" should be -- cross --;

Column 6,
Line 23, after "refer" insert -- to --;

Column 7,
Line 27, "w hereby" should be -- whereby --;

Column 8,
Line 30, delete "a" and substitute -- an -- therefor;

Column 10,
Line 32, delete "or" and substitute -- of -- therefor;
Line 35, delete "therefore".

Signed and Sealed this

Eighteenth Day of November, 2003

JAMES E. ROGAN
*Director of the United States Patent and Trademark Office*